US005620283A

United States Patent [19]

Walter

[11] Patent Number: 5,620,283

[45] Date of Patent: Apr. 15, 1997

[54] ALIGNMENT HANGER AND METHOD FOR BUILDING A BARRIER OF CONCRETE BLOCKS

[76] Inventor: Richard Walter, 1960 Francis Ave., Santa Clara, Calif. 95051

[21] Appl. No.: 548,342

[22] Filed: Nov. 1, 1995

[51] Int. Cl.[6] ..... E02D 29/00; E02D 29/02

[52] U.S. Cl. ..... 405/286; 47/83; 52/169.4; 52/604; 52/715; 405/258; 405/284

[58] Field of Search ..... 405/284, 285, 405/286; 52/715, 604, 169.4; 47/39 C, 83

[56] References Cited

U.S. PATENT DOCUMENTS 4,990,032 2/1991 Smith ..... 405/286
5,282,700 2/1994 Rodrique ..... 405/284
5,350,256 9/1994 Hammer ..... 405/286
5,403,127 4/1995 Knudsen ..... 405/286
5,417,523 5/1995 Scales ..... 405/284

*Primary Examiner*—Dennis L. Taylor
*Attorney, Agent, or Firm*—Thomas Schneck

[57] ABSTRACT

A method for building an earth-retaining barrier from standard open-celled construction blocks includes a plurality of hangers. Each hanger contains a hook portion for spanning a rim of the block and also contains a shoulder portion projecting laterally from the hook portion and having a top ledge for contacting or supporting the rim of a vertically adjoining block.. Thus, each block is supported by a block beneath it as well as by the top ledge of the hanger secured upon the lower block. The barrier thus created has an offset of approximately 15°.

16 Claims, 4 Drawing Sheets

ALIGNMENT HANGER AND METHOD FOR BUILDING A BARRIER OF CONCRETE BLOCKS

TECHNICAL FIELD

This invention relates to devices and methods for building earth-retaining barriers.

BACKGROUND ART

Materials and methods for building walls or barriers for soil, sand, rock, noise, and/or water retention are well known. In walls that are built largely without mortar to connect the blocks, retaining walls are generally comprised of specialized blocks having unusual shapes. Specialized connectors between blocks may also be necessary. For example, see U.S. Pat. Nos. 5,417,523; 5,350,256; 5,282,700; and 4,990,032 for blocks and connectors having grooves, keys, or bars for creating dovetail joints or other means for connecting the blocks together into a wall structure. Some devices and methods for building walls require complex interconnection, as in U.S. Pat. No. 5,403,127.

In many prior art wall systems, gravity retaining walls are made using specially cast concrete blocks. These blocks are of special design or shape and usually only serve one function, namely being used in the special wall systems for which they are designed. Often in these systems, the blocks are intended for all wall applications, low height walls, i.e. three feet high, as well as high walls, i.e. twenty feet high. A problem with this approach is that each block must be designed to withstand the loading of the highest walls. Designing one block or a special system for all loads or conditions is not an economical solution. This approach requires special manufacturing, stocking and shipping. What is needed is a method for quickly building an earth-retaining barrier with simple interconnections and materials. It is a further object of the present invention to provide a device which is inexpensive to manufacture and to store, and which, in combination with easily available materials, may be utilized in an earth-retaining barrier.

DISCLOSURE OF THE INVENTION

The above objects have been achieved with an alignment hanger designed for use with open-celled, common construction blocks, such as standard, partially hollow, concrete blocks, and a method for building a barrier for retaining a slope of earth with a plurality of the hangers and a plurality of construction blocks.

The hanger is a rigid, preferably unitary, plastic or other composite extruded piece. The hanger has a hook portion, which slips over a wall width, or rim, of a standard, hollow, concrete, construction block and a shoulder portion which projects laterally from the hook portion and provides additional overturning resistance while supporting a top ledge for placement of the rim of another construction block. The block system of the present invention is intended for low height gravity retaining walls up to six feet per tier, and can be used with other tie back materials if additional anchoring is required.

The hanger allows for creation of a barrier through placement of successively stacked courses of blocks with a plurality of hangers between each course of vertically adjoining blocks. Except for the bottom-most course which is preferably set on level ground, each block is supported at its front rim by a block below and at its slope side rim by at least one top ledge of the hanger on a block below. The shape of the hanger provides a slight vertical offset angle of approximately 15°. Therefore, the general slope of the barrier is also approximately 15°. "Approximately," as used here, signifies a value of ±10% of the given value. Mortar is not needed to join the blocks, nor are any special tools. The open cells of standard construction concrete blocks may be filled with earth and gravel, or other dense fill materials. These blocks can be purchased for about one-half the cost of the more expensive blocks used by the prior art. There is normally no waiting time required as materials are stocked locally at most building materials yards and thus delivery time to the project site will be improved. The blocks used in the present invention are about half the weight of other systems, allowing for more units per shipment. As an optional feature, the barrier created by the method and device of the present invention may contain gaps on its front face for planting of foliage, if desired.

BEST MODE FOR CARRYING OUT THE INVENTION

Figure 1:
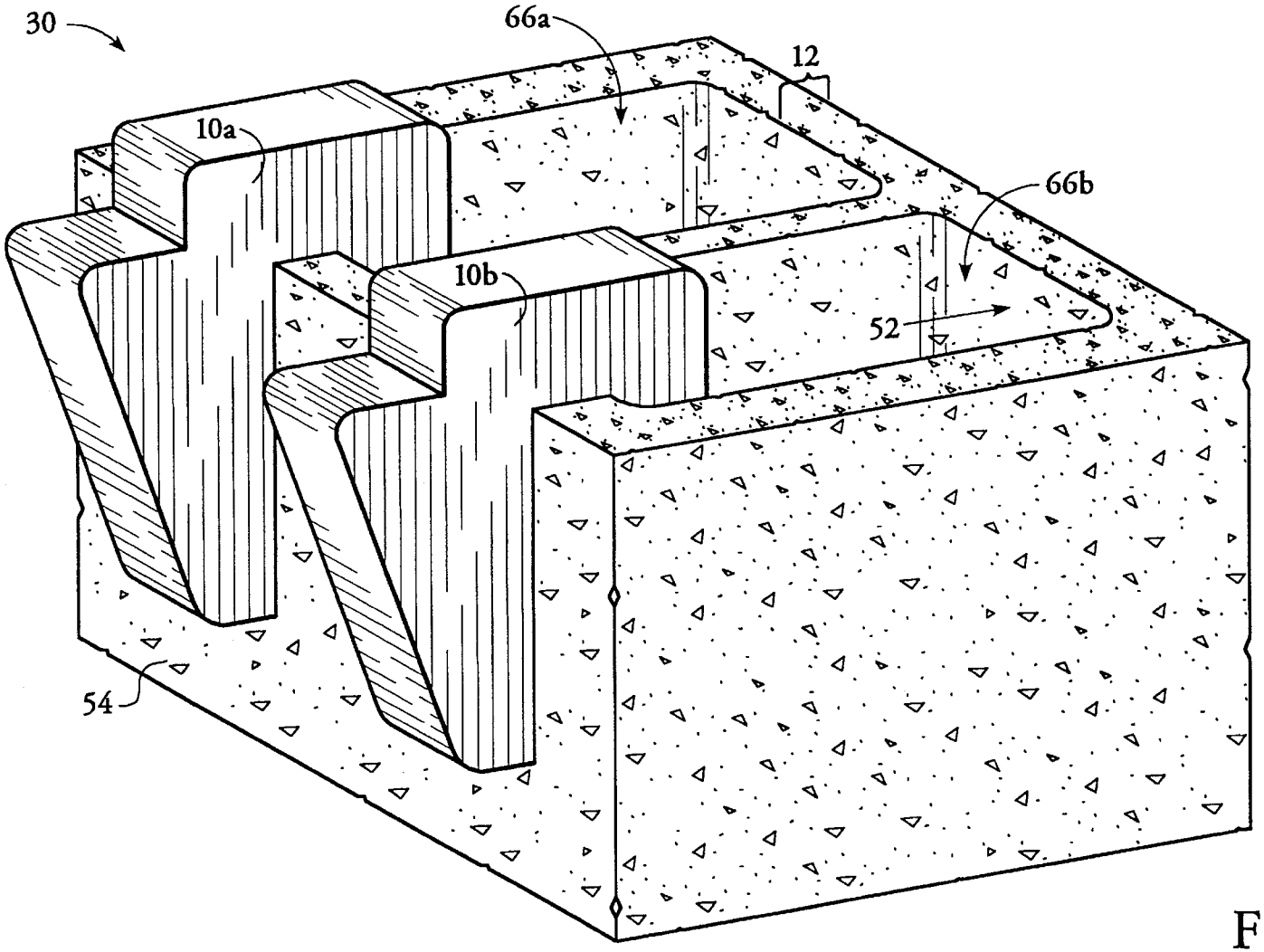
FIG. 1 is a perspective view of a standard open-celled construction block and two hangers of the present invention.

With reference to FIG. 1, a standard concrete open-celled construction block 30 is shown. The block typically has two cells or chambers 66*a* and 66*b*. Alignment hangers 10*a* and 10*b* of the present invention are shown sitting on block 30, with hanger 10*a* positioned partially within chamber 66*a* and hanger 10*b* positioned partially within chamber 66*b*. Each hanger contacts an outer wall 54 of the block. Additionally, a portion of the hanger spans past the wall width or rim 12 of the block, thus allowing for different wall thicknesses of the block or manufacturing tolerances.

Figure 2:
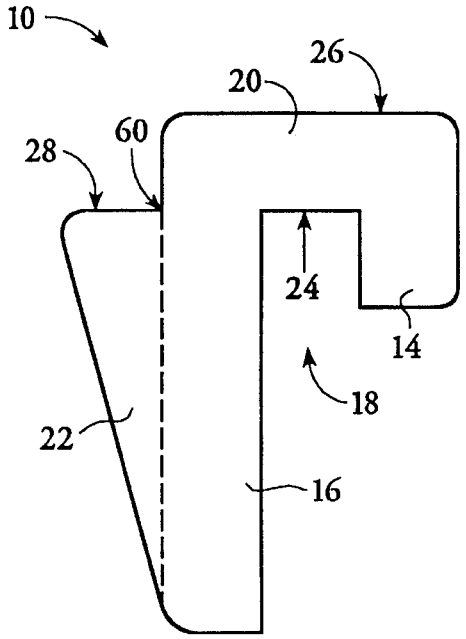
FIG. 2 is a side view of the hanger of the present invention.
Figure 3:
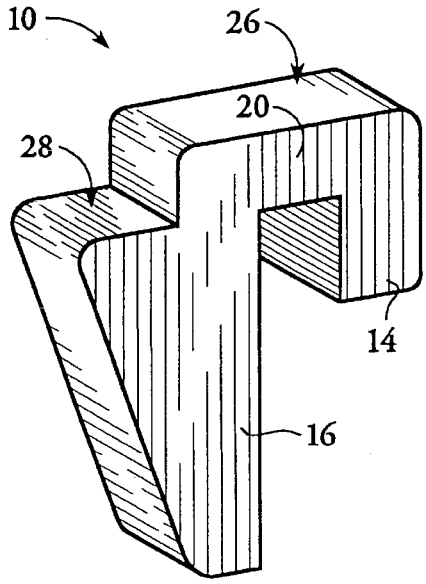
FIG. 3 is a perspective view of the hanger of the present invention.

FIGS. 2 and 3 more clearly show alignment hanger 10 of the present invention. The hanger generally comprises a hook portion 18 and a shoulder portion 22. In FIG. 2, the hook and shoulder portions are separated by a vertical dashed line. In reality, however, the hanger is preferably a unitary extruded piece of plastic, polymer, or other composite material, as more clearly seen in FIG. 3.

Hook portion 18 comprises an inner reach 14 and an outer reach 16. As seen in FIG. 1, the inner reach 14 reaches into an open chamber of the block past the inner wall 52 of the block. On wider blocks it may contact the inside wall of the block for the hook to function as intended. Outer reach 16 remains exterior to block 30 and contacts an exterior wall 54 of the block. Returning to FIG. 2, inner reach 14 and outer reach 16 are connected by a bridge 20, which forms the upper portion of the hook. The span portion of bridge 20, i.e. the distance between inner reach 14 and outer reach 16, is approximately equal to or wider than the wall width or rim 12 of the construction block 30. This allows the hanger 10 to easily slip onto rim 12 of block 30 for placement.

Figure 7:
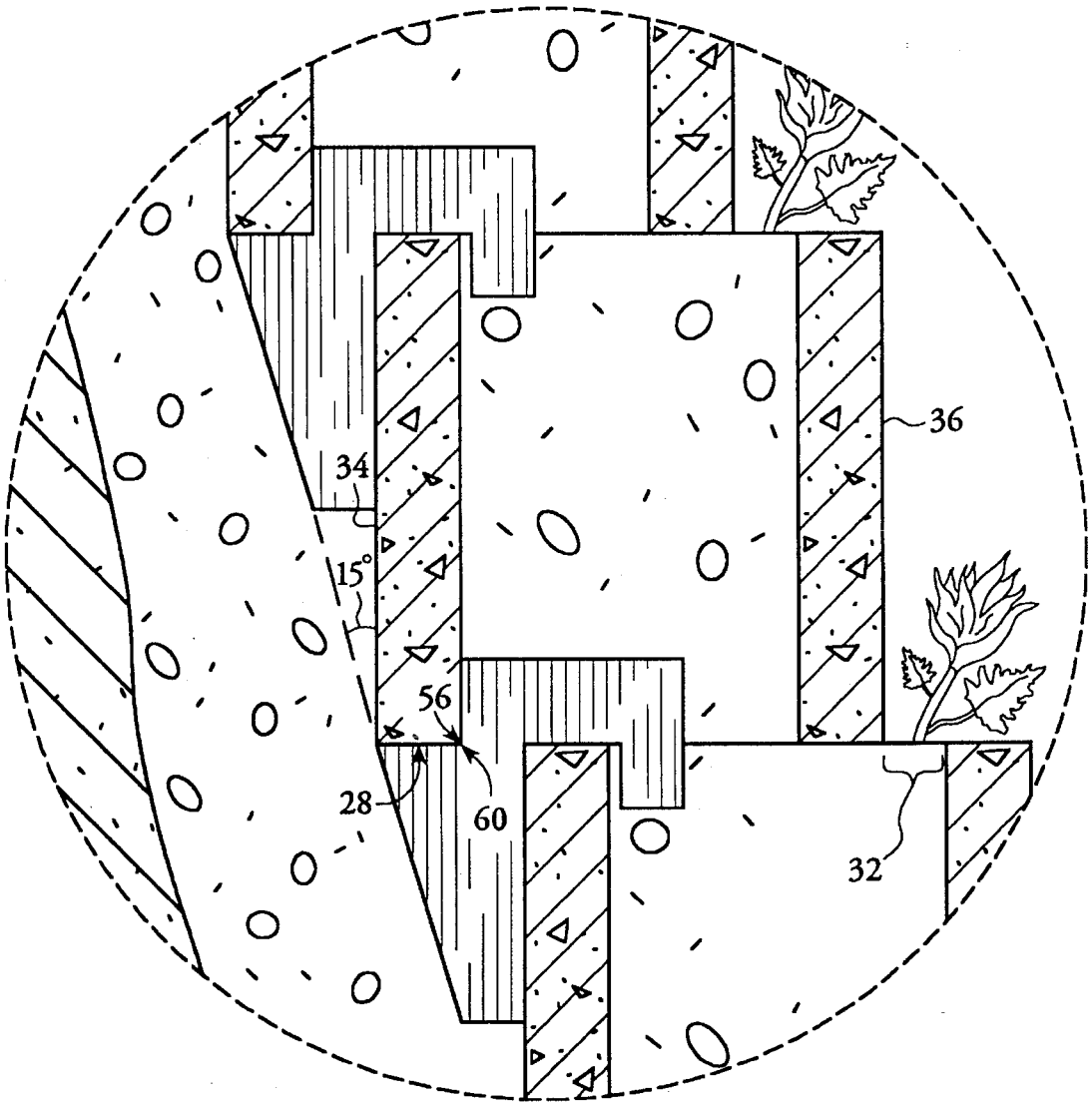
FIG. 7 is an enlarged view of a detail of FIG. 6 indicated by dashed line 7 in FIG. 6.

Shoulder portion 22 of hanger 10 projects laterally from the outer reach 16 of the hook portion. Shoulder portion 22 contains a top ledge 28 which is designed to align the rim of a vertically adjoining block and adds additional resistance in overturning loads. Top ledge 28 is preferably at least as wide as the rim 12 of the construction block 30, so that it provides full contact to the rim. FIG. 2 also shows a corner 60 formed by top ledge 28 and bridge 20. When a vertically adjoining block is positioned on top of ledge 28, the block will be pushed forward by soil backfill so that an inner corner of the block 56 abuts corner 60 of hanger 10, as seen in FIG. 7. Top ledge 28 is even with a bottom surface 24 of bridge 20. This allows the blocks to be placed in a relatively level position.

Figure 4:
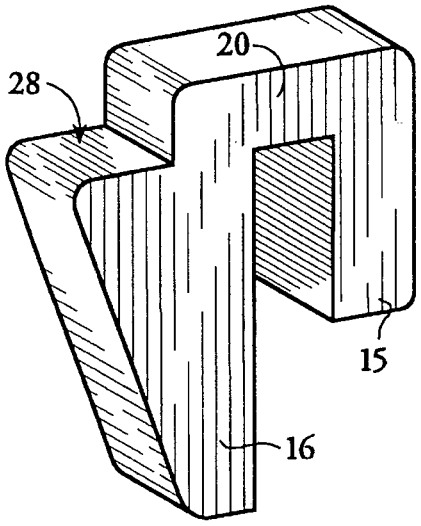
FIG. 4 is a perspective view of an alternative embodiment of the hanger of the present invention, having a deeper inside reach.
Figure 5:
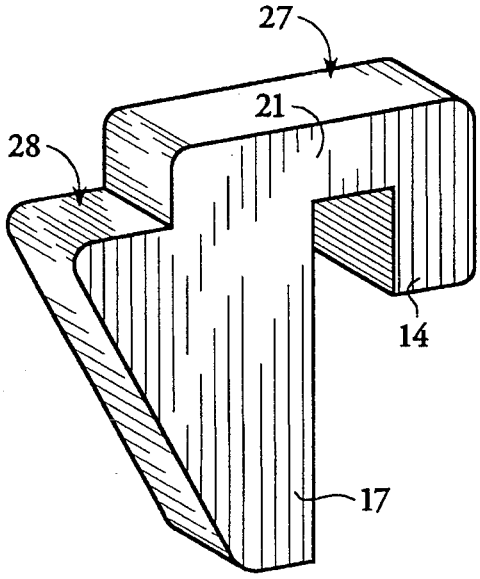
FIG. 5 is a perspective view of yet another alternate embodiment of the present invention, having a longer bridge.

FIGS. 4 and 5 show alternate embodiments of the hanger of the present invention. In FIG. 4, the inner reach 15 is extended as compared with inner reach 14 of FIGS. 2 and 3. For example, the inner reach 14 of FIG. 3 may be approximately one-third the length of the outer reach 16, whereas the inner reach 15 of FIG. 3 may be approximately one-half the length of the outer reach 16. This alternative allows the hook portion of the hanger to reach deeper into the chamber of the block and may be desired when using this system with geogrid reinforcement or other soil tieback systems. FIG. 5 shows another alternative wherein the bridge 21 and its top surface 27 are longer in length than the bridge 20 and top surface 26 of FIGS. 2 and 3. The outer reach 17 of the hook portion of the FIG. 5 embodiment may also be slightly distorted in shape, because of the bridge length, as compared with outer reach 16 of the preferred embodiment.

The length of the top surface of the bridge relative to the position of top ledge 28 of the shoulder portion determines the alignment angle of the blocks. The alignment angle is generally measured from the bottom corner of one block to the bottom corner of the vertically adjoining block, as depicted in FIG. 7. The preferred alignment hanger 10, as depicted in FIGS. 2 and 3, generally allows an alignment angle of 15°±10%. The alternative embodiment shown in FIG. 5, however, may allow a different angle, e.g. it may allow an approximately 30° alignment angle. The hanger may also be designed for a smaller alignment angle than 15°. The alignment angle ultimately determines the vertical offset angle of the barrier built with the hanger.

Figure 6:
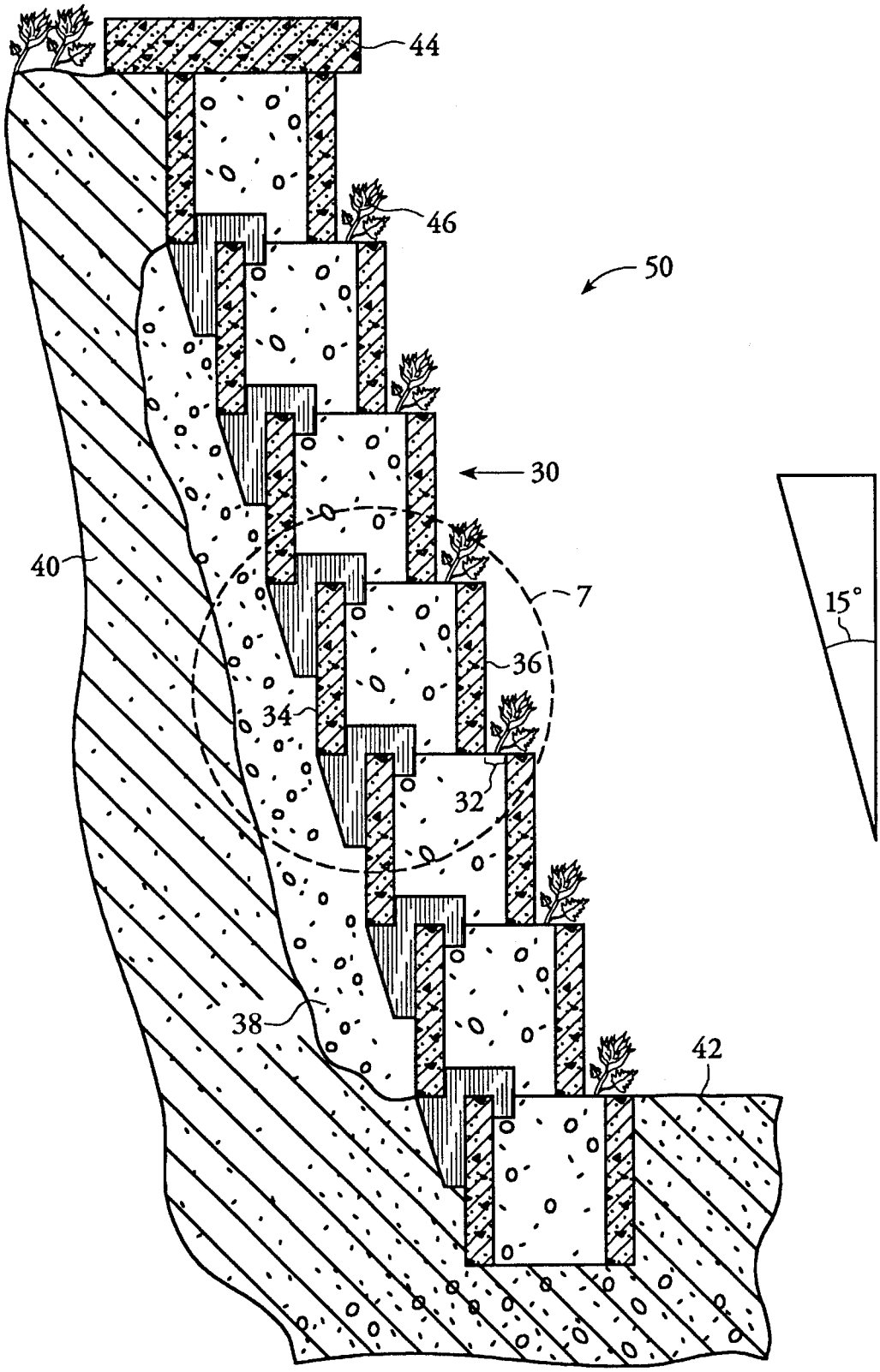
FIG. 6 is a plan view, with partial cross section, of an earth-retaining barrier utilizing the hanger and built according to the method of the present invention.

FIG. 6 shows an earth-retaining barrier built with the hanger of the present invention and standard open-celled construction blocks, according to the method of the present invention. For clarity, FIG. 7 presents an enlargement of a portion of FIG. 6. A first course of blocks is set in an open-cell-up orientation, i.e. their open cells or chambers are arranged so that they are easily accessible from above the block. This first course is preferably set on a level foundation of compacted gravel or soil on level ground. A hanger is secured onto a rim of the block facing toward the slope of earth 40, which the barrier is designed to retain. As depicted in FIG. 1, hanger 10 is positioned so that the inner reach 14 reaches into an open chamber of the block and the top ledge 28 is free to contact a rim of the vertically-adjoining block. At least one hanger is necessary per block cell, as seen in FIG. 1.

Once a first course of blocks is set in an open-cell-up orientation and hangers are secured from the blocks, a new course of blocks is set upon the directly previously set course of blocks and hangers. Then the required backfill material is added and compacted in the first course and about one-third the height of the second course. This is done by placing a slope side rim of each new block upon the top ledge of the hanger secured to the block below it and placing the front rim of the new block upon at least one of the lower, previously set blocks. The setting of the new course of blocks is followed by securement of hangers from the new set of blocks and the setting of yet another course of new blocks upon the second set course of blocks and hangers. These steps are repeated as needed to create a barrier of sufficient height to retain the slope 40. The setting of successive, vertically adjoining rows or courses creates a vertical offset, i.e. each block is slightly behind, or toward the slope, as compared to the block below it. If desired, the various courses of blocks may be staggered, so that the front rim of each newly-set block is supported upon two of the lower, previously set blocks. This may serve to stabilize the barrier created.

The barrier may be further stabilized by laterally supporting the first, or bottom-most, course of blocks by providing fill on the front side of each block of the first course. For example, earth or fill 42 is positioned on the front face of the bottom-most block seen in the wall of FIG. 6. Additionally, the open cells of each set block may be filled with earth or gravel fill after securing the hanger on the set block and before setting the new block upon the hanger of the set block, as the barrier is created.

FIGS. 6 and 7 show that the vertical offset created by the alignment hanger of the present invention leaves gaps 32 between the front sides 36 of vertically adjoining blocks. These may be filled with foliage 46, so that the barrier 50 is more suitable to its environment. At least one flat plate 44 may also be positioned over the last course of blocks when the barrier is of sufficient height. This serves to cover over the open cells of the last course of blocks and helps to prevent water seepage through the open cells which may lead to erosion of the fill within the blocks.

The alignment hanger is inexpensive to manufacture and to store and is easily usable by unskilled persons. The standard construction blocks which are utilized to build the barrier, in combination with the alignment hangers, are lighter than the specialized construction blocks created for many retaining walls and, thus, are easier to install, as well. However the completed wall is of sufficient weight for retainment of the lower wall tiers. This ease of utility saves on labor costs. The present invention may also be combined with other soil stabilization and tieback systems.

I claim:

1. A hanger for aligning open-celled construction blocks to form a sloped barrier, the hanger comprising, a hook portion having an inside reach for lapping over a slope side wall of a block, an outside reach for contacting an outside wall of the block, and a bridge connecting the inside reach and the outside reach and for spanning a rim of the block, and a shoulder portion projecting laterally from the outside reach of the hook portion and having a top ledge for receiving a rim of a vertically adjoining block, the top ledge of the shoulder being coplanar with a bottom surface of the hook portion.

2. The hanger of claim 1 wherein the top ledge of the shoulder portion is below a top surface of the bridge of the hook portion.

3. The hanger of claim 1 wherein the top ledge of the shoulder portion is equal or wider in length to the rim of the vertically adjoining block.

4. The hanger of claim 1 wherein the hook portion spans the rim of the slope side wall of the block and the top ledge contacts the rim on a slope side wall of the vertically adjoining block.

5. The hanger of claim 1 wherein the length of a top surface of the bridge and the position of the top ledge of the shoulder portion relative to the top surface of the bridge determine the alignment angle of the blocks, the alignment angle being measured from the bottom corner of one block to the bottom corner of the vertically adjoining block.

6. The hanger of claim 5 wherein the alignment angle is 15°±10%.

7. The hanger of claim 1 wherein the inside reach of the hook portion is approximately one-third the length of the outside reach of the hook portion.

8. The hanger of claim 1 wherein the inside reach of the hook portion is approximately one-half the length of the outside reach of the hook portion.

9. The hanger of claim 1 wherein the hook portion and the shoulder portion are comprised of a unitary piece of extruded polymer.

10. A method of building a barrier with open-celled construction blocks to retain a slope of earth, the method comprising, (a) setting a first course of blocks in an open-cell-up orientation, (b) securing at least one hanger from a slope side of each set block, the hanger being of the type having a hook portion for closely spanning a rim of the block and a shoulder portion with a top ledge projecting in a direction toward the slope side and laterally away from the hook portion for contacting a rim of a vertically adjoining block, the hook portion having a bottom surface in contact with the rim, the bottom surface being coplanar with the top ledge, (c) setting a new course of blocks in an open-cell-up orientation directly upon the previously set course of blocks and hangers by placing a rim on the slope side of each block of the new course upon the top ledge of the hanger secured to one of the previously set blocks and placing a rim on a front side of each block of the new course directly upon at least one of the previously set blocks so as to cause the new course and the previously set course to adjoin vertically with a vertical offset, (d) repeating steps (b) and (c) as needed to create a barrier of sufficient height to retain the slope of earth.

11. The method of claim 10 wherein the step of setting a new course of blocks directly upon the previously set course of blocks and hangers further comprises staggering the new course of blocks by positioning the rim on the front side of each block of the new course directly upon two of the previously set blocks.

12. The method of claim 10 wherein the step of setting a first course of blocks further comprises setting the first course of blocks on level ground, and laterally supporting the first course of blocks by providing fill on the front side of each block of the first course.

13. The method of claim 10 further comprising filling the open-cells of each block of the set course with earth or gravel fill after securing the hanger on the set block and before setting the blocks of the new course upon the hanger and the set block.

14. The method of claim 10 further comprising positioning at least one flat plate over the open cells of a last course of blocks when the barrier is of sufficient height to retain the slope of earth.

15. The method of claim 10 wherein the step of setting a new course of blocks directly upon the previously set course of blocks and hangers allows the formation of gaps between the front sides of vertically adjoining blocks.

16. In an earth-retaining barrier having vertically adjoining courses of open-celled construction blocks, the improvement comprising a plurality of alignment hangers, each hanger including a hook portion having an inside reach for lapping over an inside wall of a construction block, an outside reach for contacting an outside wall of the block, a bridge connecting the inside reach and the outside reach and for spanning a rim of the block, and a shoulder portion projecting laterally from the outside reach of the hook portion and having a top ledge, the bridge having a bottom surface contacting the rim, the top ledge being coplanar with the bottom surface, the hangers serving to align and offset each successive course of blocks through securement of each hanger on one of the blocks with the hook portion of the hanger spanning the slope side rim of a lower block and the top ledge of the shoulder portion of the hanger contacting the slope side rim of an upper block.

* * * * *